US008240174B2

(12) United States Patent
Soeda

(10) Patent No.: US 8,240,174 B2
(45) Date of Patent: Aug. 14, 2012

(54) UNDERGARMENT

(75) Inventor: Tsuyoshi Soeda, Osaka (JP)

(73) Assignee: Teijin Fibers Limited, Osaka (JP)

( * ) Notice: Subject to any disclaimer, the term of this patent is extended or adjusted under 35 U.S.C. 154(b) by 308 days.

(21) Appl. No.: 12/665,614

(22) PCT Filed: Jul. 3, 2008

(86) PCT No.: PCT/JP2008/062432

§ 371 (c)(1),
(2), (4) Date: Dec. 18, 2009

(87) PCT Pub. No.: WO2009/011268

PCT Pub. Date: Jan. 22, 2009

(65) Prior Publication Data

US 2010/0319409 A1 Dec. 23, 2010

(30) Foreign Application Priority Data

Jul. 19, 2007 (JP) ..... 2007-188127

(51) Int. Cl.
*D04B 1/24* (2006.01)

(52) U.S. Cl. ..... 66/171; 450/93

(58) Field of Classification Search ..... 66/169 R, 66/170, 171, 196, 202; 450/20, 21, 39, 40, 450/93

See application file for complete search history.

(56) References Cited

U.S. PATENT DOCUMENTS

| | | | | | |
|---|---|---|---|---|---|
| 920,207 | A * | 5/1909 | Steber | 66/201 |
| 4,213,312 | A * | 7/1980 | Safrit et al. | 66/177 |
| 4,733,546 | A * | 3/1988 | Toda | 66/202 |
| 5,373,713 | A * | 12/1994 | Miller | 66/196 |
| 2010/0319409 | A1 * | 12/2010 | Soeda | 66/176 |

FOREIGN PATENT DOCUMENTS

| | | | |
|---|---|---|---|
| JP | 4-308245 | A | 10/1992 |
| JP | 2001-064829 | A | 3/2001 |
| JP | 2001-348735 | A | 12/2001 |
| JP | 2003-227056 | A | 8/2003 |
| JP | 2004-11074 | A | 1/2004 |
| JP | 2004-124273 | A | 4/2004 |
| JP | 2005-226171 | A | 8/2005 |
| JP | 2005-320666 | A | 11/2005 |
| JP | 2006-132075 | A | 5/2006 |
| JP | 2007-009395 | A | 1/2007 |
| JP | 2007-100243 | A | 4/2007 |
| WO | 2006/013317 | A2 | 2/2006 |

* cited by examiner

*Primary Examiner* — Danny Worrell
(74) *Attorney, Agent, or Firm* — Sughrue Mion, PLLC

(57) ABSTRACT

An undergarment is provided that favorably adheres to the skin and has superior shape retention. The undergarment according to the present invention is an undergarment that is comprised of a fabric having a woven structure, a knitted structure or a non-woven fabric structure, wherein the fabric contains a filament yarn A having a filament diameter of 10 to 1000 nm and a filament yarn B having a filament diameter greater than 1000 nm, and the filament yarn A is exposed on the side that contacts the skin.

10 Claims, 2 Drawing Sheets

UNDERGARMENT

TECHNICAL FIELD

The present invention relates to an undergarment that favorably adheres to the skin and has superior shape retention.

BACKGROUND ART

The obtaining of undergarments using various types of fibers such as microfibers has been proposed in the prior art (see, for example, Japanese Unexamined Patent Publications Nos. S58-180208, H3-40830, 2001-262407 and 2001-303308). However, these undergarments had the problem of poor adherence to skin causing the undergarments to easily shift position.

On the other hand, known methods for preventing slippage between fiber products and skin consist of the use of rubber-like stretchable threads or coiled crimpable threads, and carrying out secondary processing such as nap raising processing or resin processing on the surface of fiber products.

However, since methods using stretchable thread or crimpable thread require adequate constriction to obtain anti-slipping effects, they had the problem of causing circulatory disorders, and depending on the case, injuries to the skin. On the other hand, in methods using secondary processing, there were problems such as increased costs and a reduction in anti-slipping effects resulting from loss of surface form and shaping agents caused by wear. In addition, these methods also had the problem of suffering in anti-slipping effects due to the presence of moisture generated by perspiration or rain.

Furthermore, fabrics are known that use ultrafine fibers referred to as nanofibers (see, for example, Japanese Unexamined Patent Publications Nos. 2003-41432, 2004-162244, 2005-23466 and 2007-2364).

DISCLOSURE OF THE INVENTION

In consideration of the background as described above, an object of the present invention is to provide an undergarment that favorably adheres to the skin and has superior shape retention.

Means for Solving the Problems

As a result of conducting extensive studies to achieve the aforementioned object, the inventors of the present invention found that when an undergarment is obtained using ultra-fine fibers and coarse fibers so that the ultra-fine fibers are exposed on the side that contacts the skin, the undergarment is resistant to shifting position due to favorable adherence between the undergarment and skin while also demonstrating satisfactory shape retention, thereby leading to completion of the present invention through additional extensive studies.

Thus, according to the present invention, an undergarment is provided that contains a fabric having a woven structure, a knitted structure or a non-woven fabric structure, wherein the fabric contains a filament yarn A having a filament diameter of 10 to 1000 nm and a filament yarn B having a filament diameter greater than 1000 nm, and the filament yarn A is exposed on the side that contacts the skin.

The exposed filament yarn A preferably accounts for 50% or more of the surface area of the side that contacts the skin, and more preferably, only the filament yarn A is exposed on the side that contacts the skin.

The number of filaments of the filament yarn A is preferably 500 or more. In addition, the number of filaments of the filament yarn B is preferably within the range of 1 to 300.

The fabric is preferably a knitted fabric obtained by interlocking the filament yarn A and the filament yarn B.

The filament yarn A is preferably a polyester fiber, and the filament yarn B is preferably an elastic fiber.

The weight ratio of the filament yarn A to the filament yarn B is preferably within the range of 95:5 to 5:95.

The frictional resistance value of the side of the undergarment of the present invention that contacts the skin is preferably 150 gr or more. However, the frictional resistance value is the resistance value (gr) measured according to the method described below. Namely, a piece of silicone rubber is placed on a horizontal table, a head having a bottom surface area of 5 cm×8 cm, a height of 3 cm and a weight of 100 gr (0.98 N) on which a sample is affixed to the entire bottom surface thereof is arranged on the silicone rubber, and the head is pulled in the horizontal direction at a rate of 100 Nm/min with a tensile tester followed by determination of the resistance value (gr) at that time.

In addition, the undergarment is preferably any undergarment selected from the group consisting of brassieres, shorts, lingerie, girdles, undershirts, men's underpants and women's underpants.

According to the present invention, an undergarment is obtained that favorably adheres to the skin and has superior shape retention.

BEST MODE FOR CARRYING OUT THE INVENTION

Figure 1:
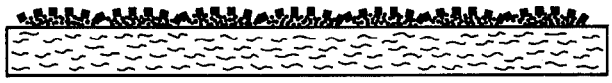
FIG. 1 is a schematic drawing showing a fabric used in an undergarment of the present invention.

The following is a detailed explanation of embodiments of the present invention.

An undergarment of the present invention contains a filament yarn A having a filament diameter of 10 to 1000 nm and a filament yarn B having a filament diameter greater than 1000 nm.

In the filament yarn A (which may also be referred to as nanofibers), it is imperative that the filament diameter thereof (diameter of single fibers) be within the range of 10 to 1000 nm (preferably 100 to 800 nm and particularly preferably 550 to 800 nm). Conversion of this filament diameter to single fiber fineness yields an equivalent value of 0.000001 to 0.01 dtex. In the case the filament diameter is smaller than 10 nm, fiber strength decreases, which is not preferable in terms of practical use. Conversely, in the case the filament diameter is greater than 1000 nm, there is the risk of the fabric not demonstrating adherence to the skin, thereby making this undesirable. In the case the cross-sectional shape of the filaments is an irregularly shaped cross-section other than a circular cross-section, the diameter of a circumscribed circle thereof is defined as the filament diameter. Furthermore, filament diameter can be measured by photographing a horizontal cross-section of the fibers with a transmission electron microscope.

Although there are no particular limitations on the number of filaments of the filament yarn A, the number of filaments is preferably 500 or more (and more preferably 2000 to 50000) in terms of obtaining the unique texture of ultrafine fibers. In addition, the total fineness of the filament yarn A (product of filament fineness times number of filaments) is preferably within the range of 5 to 150 dtex.

Although there are no particular limitations on the shape of the fibers of the filament yarn A, it is preferably a long fiber (multifilament yarn). There are also no particular limitations on the cross-sectional shape of the filaments, and may have a known cross-sectional shape such as a circular, triangular, flat or hollow shape. In addition, the filaments may be subjected to ordinary air processing or false-twist crimping.

There are no particular limitations on the type of polymer that forms the filament yarn A provided it is a polyester-based polymer, preferable examples of which include polyethylene terephthalate, polytrimethylene terephthalate, polybutylene terephthalate, polylactic acid and polyester copolymerized with a third component. The polyester may be material-recycled polyester or chemically recycled polyester. Moreover, the polyester may also be a polyester obtained using a catalyst containing a specific phosphorous compound or titanium compound as described in Japanese Unexamined Patent Publication No. 2004-270097 or 2004-211268, or polylactic acid or stereocomplex polylactic acid. One or more types of a pore forming agent, cationic dyeing agent, coloring preventive agent, heat stabilizer, fluorescent whitener, matting agent, colorant, moisture absorbent or inorganic fine particles may also be contained in the polymer as necessary within a range that does not impair the object of the present invention.

On the other hand, it is imperative that the filament yarn B has a filament diameter of greater than 1000 nm (and preferably 2 to 33 μm). Furthermore, 33 μm is equivalent to a fiber fineness of about 10 dtex. If the filament diameter is equal to or less than 1000 nm (1 μm), there is the risk of the shape retention of the undergarment being lost, thereby making this undesirable. In the case the cross-sectional shape of the filaments is an irregularly shaped cross-section other than a circular cross-section, the diameter of a circumscribed circle thereof is defined as the filament diameter. Furthermore, filament diameter can be measured by photographing a horizontal cross-section of the fibers with a transmission electron microscope.

Although there are no particular limitations on the number of filaments of the filament yarn B, the number of filaments is preferably within the range of 1 to 300. In addition, although there are no particular limitations on the shape of the fibers of the filament yarn B, and it may be a spun yarn, it is preferably a long fiber (multifilament yarn). There are also no particular limitations on the cross-sectional shape of the filaments, and may have a known cross-sectional shape such as a circular, triangular, flat or hollow shape. In addition, the filaments may be subjected to ordinary air processing or false-twist crimping.

There are no particular limitations on the type of polymer that forms the filament yarn B provided it is a polyester-based polymer, preferable examples of which include polyethylene terephthalate, polytrimethylene terephthalate, polybutylene terephthalate, polylactic acid, polyester copolymerized with a third component, polyether ester and urethane. The polyester may be material-recycled polyester or chemically recycled polyester. Moreover, the polyester may also be a polyester obtained using a catalyst containing a specific phosphorous compound or titanium compound as described in Japanese Unexamined Patent Publication No. 2004-270097 or 2004-211268, or polylactic acid or stereocomplex polylactic acid. An elastic resin such as polyether ester or polyurethane is particularly preferable in terms of imparting elasticity to the undergarment fabric. One type or two or more types of a pore forming agent, cationic dyeing agent, coloring preventive agent, heat stabilizer, fluorescent whitener, matting agent, colorant, moisture absorbent or inorganic fine particles may also be contained in the polymer as necessary within a range that does not impair the object of the present invention.

Furthermore, although one type of fiber is preferably used in the filament yarn A and filament yarn B, a plurality of types may be used in combination. For example, composite yarn in which polyester-based fiber threads are air-mixed with elastic fiber threads comprising polyurethane fiber or polyether ester fiber by an interlacing air nozzle and the like, composite yarn in which polyester-based threads are covered around elastic fiber threads may be used, or composite yarn incorporating spun yarn may be used.

In an undergarment of the present invention, the filament yarn A is exposed on the side that contacts the skin. Superior adherence to the skin is obtained by exposing nanofibers on the side that contacts the skin in this manner. In an electron micrograph obtained by photographing the surface of a knit fabric (back) at a magnification of 50× using an electron microscope, when surface area AA occupied by the filament yarn A and surface area BA occupied by the filament yarn B are measured, the value of the surface area ratio (%) of the filament yarn A (=AA/(AA+BA)×100) is preferably 50% or more. Allowing only the filament yarn A to be exposed on the side that contacts the skin as previously described is preferable in that it enables the obtaining of superior adherence to the skin.

Furthermore, in an undergarment of the present invention, the filament yarn A may or may not be exposed on the side opposite from the side that contacts the skin.

An undergarment of the present invention can be produced according to, for example, the production process described below. First, sea-island composite fibers (fibers for filament yarn A) are prepared that are formed from a sea component and an island component composed of polyester and having a diameter of 10 to 1000 nm. A sea-island composite fiber multifilament (number of islands: 100 to 1500) is preferably used for the sea-island composite fibers.

Namely, polyester, polyamide, polystyrene or polyethylene and the like having favorable fiber formability is preferable for the sea component polymer. For example, polylactic acid, ultra-high molecular weight polyalkylene oxide condensed polymer, polyethylene glycol-based compound copolymer polyester, or a copolymer polyester of a polyethylene glycol-based compound and sodium 5-sulfoisophthalate is preferable for use as an aqueous alkaline solution-soluble polymer. Polyethylene terephthalate-based copolymer polyester having an intrinsic viscosity of 0.4 to 0.6, which is obtained by copolymerizing 6 to 12 mol % of sodium 5-sulfoisophthalate and 3 to 10% by weight of polyethylene glycol having a molecular weight of 4000 to 12000, is particularly preferable.

On the other hand, the island component is preferably polyethylene terephthalate, trimethylene terephthalate, polybutylene terephthalate, polylactic acid or polyester such as a polyester copolymerized with a third component having fiber formability. One or more types of a pore forming agent, cationic dyeing agent, coloring preventive agent, heat stabilizer, fluorescent whitener, matting agent, colorant, moisture absorbent or inorganic fine particles may be contained in the polymer as necessary within a range that does not impair the object of the present invention.

The sea-island composite fibers composed of a sea component polymer and an island component polymer as described above preferably has a melt viscosity of the sea component that is higher than the melt viscosity of the island component polymer during melt spinning. In addition, the diameter of the island component is required to be within the range of 10 to 1000 nm. At that time, the diameter of a circumscribed circle thereof is determined in the case the shape of the island component is not circular. In the sea-island composite fibers described above, the sea-island composite mass ratio (sea:island) is preferably within the range of 40:60 to 5:95, and particularly preferably within the range of 30:70 to 10:90.

The sea-island composite fiber multifilament yarn can be easily produced according to, for example, the process described below. Namely, the sea component polymer and the island component polymer are melt-spun. An arbitrary spinneret can be used for melt spinning, such as that having a hollow pin group or fine pore group for forming the island component. The discharged sea-island composite fiber multifilament yarn is solidified by cooling air, and preferably wound after melt-spinning at 400 to 6000 m/min. The resulting undrawn yarn may be formed into composite fibers having desired strength, elongation and heat shrinkage properties by going through a separate drawing step, or the yarn may be taken up by a roller at a constant speed without winding followed by winding after going through a drawing step. In this sea-island composite fiber multifilament yarn, it is preferable that the single fiber fineness be within the range of 0.5 to 10.0 dtex, the number of filaments within the range of 5 to 75, and the total fineness within the range of 30 to 170 dtex. In addition, the boiling water shrinkage factor of this sea-island composite fiber multifilament yarn is preferably within the range of 5 to 30%.

On the other hand, the filament B is prepared having a single fiber fineness of 0.1 dtex or more (and preferably 0.1 to 50 dtex). The filament diameter of the filament yarn B in the ultimately obtained fabric is preferably greater than 1000 nm, and the single fiber fineness is preferably within the previously described range.

In the filament yarn B, the number of filaments and the total fineness are within the ranges of 1 to 300 and 0.1 to 50 dtex, respectively. In addition, this filament yarn is preferably a high-shrinkage polyester or elastic yarn (polyurethane elastic yarn or polyether ester elastic yarn) that has a boiling water shrinkage factor of 10% or more (and more preferably 20 to 40%). Furthermore, a copolymer polyester is spun and drawn in accordance with ordinary methods to obtain a high boiling water shrinkage factor as previously described. At that time, the copolymer polyester is preferably that in which the primary constituent monomers of the copolymer polyester are terephthalic acid and ethylene glycol, and a third component that copolymerizes with the primary constituent monomer is selected from the group consisting of isophthalic acid, naphthalene dicarboxylic acid, adipic acid, sebacic acid, diethylene glycol, polyethylene glycol, bisphenol A and bisphenol sulfone. In particular, the copolymer polyester is preferably such that the acid component is composed of terephthalic acid and isophthalic acid at a molar ratio (terephthalic acid/isophthalic acid) of 90/5 to 85/15, and the glycol component is composed of ethylene glycol. The use of such a copolymer polyester allows the obtaining of a higher boiling water shrinkage factor.

Next, a woven/knit fabric can be woven and knit using the aforementioned sea-island composite fiber filament yarn and the filament yarn B so that the sea-island composite fiber filament yarn is exposed on the side of the fabric that contacts the skin. At that time, although the sea-island composite fiber filament yarn and the filament yarn B may be contained in a woven/knit fabric in the form of a combined filament yarn, a woven fabric or knit fabric is preferably woven or knit by interlocking or interweaving the filament yarn A and the filament yarn B. In the case the filament yarn B is an elastic yarn, if it is supplied while drawing by 1.5 times or more (and preferably 1.5 to 3.0 times), the filament yarn B is located on the inside of the woven/knit fabric, and only the filament yarn A is exposed on the front surface and back surface of the woven/knit fabric, thereby making this preferable.

The total fineness ratio of the sea-island composite fiber filament yarn to the filament yarn B is preferably within the range of 90:10 to 50:50. There are no particular limitations on the woven structure and knit structure. Examples of weft knit structures include, but are not limited to, plain stitch, rib stitch, interlock stitch, pearl stitch, tuck stitch, float stitch, single rib stitch, lace stitch and plated stitch, while examples of warp knit structures include, but are not limited to, single denbigh stitch, single atlas stitch, double cord stitch, half stitch, half base stitch, satin stitch, half tricot stitch, backing stitch and jacquard stitch. Examples of woven structures include, but are no limited to, three primary structures such as flat weave, twilled square weave and satin weave, deflected woven structures, single-backed double weave structures such as warp-backed weave or weft-backed weave, and warp velvet stitch. The number of layers may be a single layer or two or more multiple layers.

Examples of non-woven fabric structures include, but are not limited to, spunbond non-woven fabric, melt-blown non-woven fabric, dry non-woven fabrics (needle punch, air-laid, spunlace, thermal bonding or resin bonding) and wet non-woven fabrics (wet-laid or wet spunlace).

Next, aqueous alkaline solution treatment is carried out on the fabric and dissolving and removing the sea component of the sea-island composite fibers with the aqueous alkaline solution to convert the sea-island composite fiber filament yarn into multifilament yarn A having a filament diameter of 10 to 1000 nm and obtain a fabric for an undergarment of the present invention. At that time, conditions of aqueous alkaline solution treatment consist of using an aqueous NaOH solution having a concentration of 3 to 4% at a temperature of 55 to 65° C.

In addition, dyeing processing may also be carried out on the fabric before and/or after dissolution and removal with the aqueous alkaline solution. Calendar processing (heated pressurization processing) may also be carried out. Moreover, fiber raising processing or water repellency processing, as well as various types of processing involving the imparting of a function such as that of an ultraviolet blocker, antistatic agent, antibacterial agent, deodorizing agent, insect repellent, light storage agent, retroreflection agent or negative ion generator, may also be additionally applied.

Figure 4:
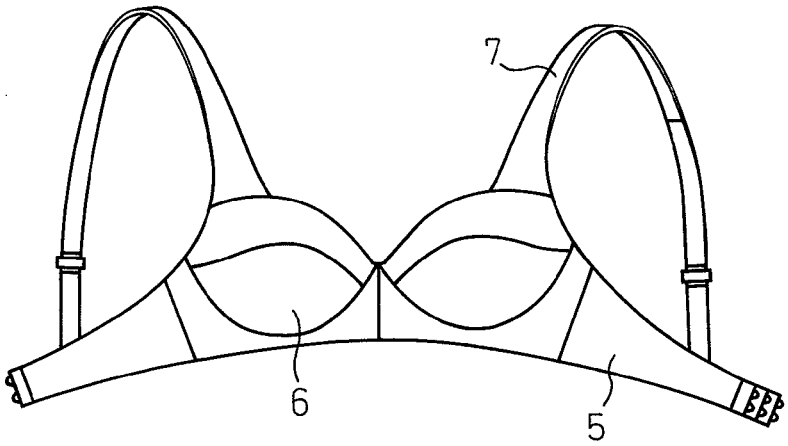
FIG. 4 is a schematic drawing showing a brassiere.

Next, an undergarment is produced according to ordinary methods using the fabric described above. At that time, it is imperative that the fabric be sewn so that the filament yarn A (nanofibers) is exposed on the side that contacts the skin. In addition, although an undergarment may be composed of this fabric alone, a multilayer structure may also be employed in which the fabric is arranged on the skin side, while an ordinary polyester woven/knit fabric, for example, is arranged on the outer side. Moreover, accessories such as pads or decorations may also be contained. In addition, although there are no particular limitations on the type of undergarment, an undergarment selected from the group consisting of a brassiere, shirt, lingerie, girdle, undershirt, men's underpants and women's underpants is preferable. The brassiere schematically shown in FIG. 4 consisting of wings 5, cups 6 and shoulder straps 7 is particularly preferable. Furthermore, the shoulder straps 7 may or may not be present.

Figure 2:
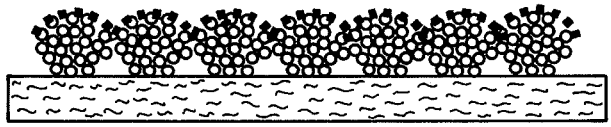
FIG. 2 is a schematic drawing showing a fabric used in an undergarment of the prior art.
Figure 3:
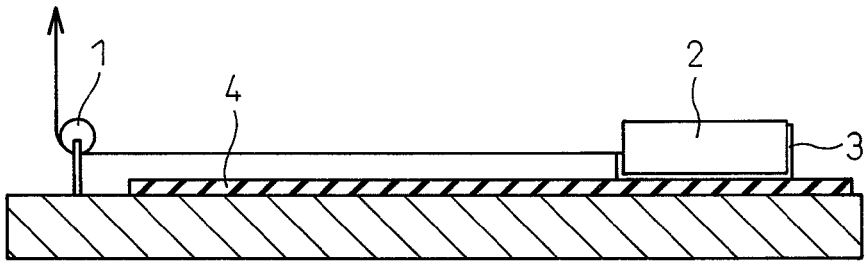
FIG. 3 is a schematic drawing showing a method for measuring frictional resistance.

In an undergarment obtained in this manner, since the filament yarn A (nanofibers) is exposed on the side that contacts the skin, adherence between the fabric and skin is improved. Although the reason for the improvement in adherence has yet to be determined, it is presumed to be due to an increase in the contact surface area with the skin when the fabric surface is flat as schematically shown in FIG. 1 in comparison with the fabric surface of a conventional undergarment schematically shown in FIG. 2. Furthermore, the frictional resistance value on the side that contacts the skin in a dry state (environment at a temperature of 20° C. and relative humidity of 65% RH) is preferably 150 gr or more (and particularly preferably 200 to 600 gr). In addition, the frictional resistance value is preferably 150 gr or more (and particularly preferably 200 to 600 gr) even in the wet state. However, the frictional resistance value refers to the resistance value (gr) measured according to the method described below. Namely, as schematically shown in FIG. 3, a piece of silicone rubber 4 is placed on a horizontal table, a head 2 having a bottom surface area of 5 cm×8 cm, a height of 3 cm and a weight of 100 gr (0.98 N) on which a sample 3 is affixed to the entire bottom surface thereof is arranged on the silicone rubber, and the head 2 is pulled in the horizontal direction at a rate of 100 nm/min with a tensile tester (not shown) via a pulley 1 followed by determination of the resistance value (gr) at that time. In addition, when measuring the frictional resistance value in a wet state, 1.0 mL of water is applied to a sample measuring 10×20 cm.

In addition, since an undergarment of the present invention contains the filament yarn B having a filament diameter greater than 1000 nm, the resulting fabric has high rigidity and demonstrates superior shape retention.

EXAMPLES

Although the following provides a detailed description of examples and comparative examples of the present invention, the present invention is not limited thereto. Furthermore, each of the measured parameters in the examples was measured using the methods described below.

<Melt Viscosity>

After placing a polymer following drying treatment in an orifice set to the extruder melt temperature during spinning and retaining in a molten state for 5 minutes, the polymer is extruded by applying several levels of loads and plotting the shear rates and melt viscosities at those times. The points of the plot are then connected into a smooth line to prepare a shear rate vs. melt viscosity curve followed by determining the melt viscosity at a shear rate of 1000 $sec^{-1}$.

<Dissolution Rate>

The sea and island components are respectively wound at a spinning rate of 1000 to 2000 m/min with a 0.3ϕ, 0.6 L×24 H spinneret and then drawn so that the residual elongation is within the range of 30 to 60% to prepare 84 dtex/24 fil multifilaments. Weight loss rate was then calculated from the dissolution time and dissolved amount based on a volume ratio of 100 at the temperature at which the multifilaments are to be dissolved with each solvent.

<Filament Diameter>

The fabric was photographed with an electron microscope followed by measuring filament diameter at n points (n=5) and determining the average value thereof.

<Surface Area Ratio of Filament Yarn A Exposed on Fabric Surface (Back Surface)>

After photographing the knitted fabric (back surface) with an electron microscope at a magnification of 50×, surface area AA occupied by the polyester filament yarn A and surface area BA occupied by the filament yarn B in the resulting electron micrograph were measured followed by calculating the surface area ratio of the polyester filament yarn A (=AA/(AA+BA)×100).

<Frictional Resistance Value>

The frictional resistance value (gr) was measured according to the method described below as a substitute characteristic of adherence. Namely, as schematically shown in FIG. 3, a piece of silicone rubber (Sumitomo 3M Ltd., product name: Silicone 50) was placed on a horizontal table, a head having a bottom surface area of 5 cm×8 cm, a height of 3 cm and a weight of 100 gr (0.98 N) on which a sample was affixed to the entire bottom surface thereof was arranged on the silicone rubber, and the head was pulled in the horizontal direction at a rate of 100 nm/min with a tensile tester (Instron Corp., Model 5566) followed by measurement of the resistance value (gr) at that time. In addition, the wet state refers to the state in which 1.0 mL of water was applied to a sample measuring 10 cm×20 cm.

<Adherence to Skin>

The brassiere obtained in Example 1, described later, and the brassiere obtained in Comparative Example 1, described later, were test-worn for 1 month by 10 testers, after which the testers evaluated the brassieres for shifting of the brassiere from the chest during the course of ordinary daily movement to one of three of the following grades: grade 3: favorable adherence with hardly any shifting of position; grade 2: some shifting depending on movement; and, grade 1: poor adhesion with considerable shifting of position.

<Comfort Test>

A comfort test was also conducted simultaneous to evaluation of adherence to the skin by evaluating to one of the following three grades: grade 3: extremely favorable and would like to continue to wear; grade 2: average; and grade 1: considerable discomfort and would not wear again.

Example 1

Sea-island composite undrawn fibers, having a sea to island ratio of 30:70 and 836 islands for the number of islands, and consisting of an island component of polyethylene terephthalate (melt viscosity at 280° C.: 1200 poise, matting agent content: 0% by weight) and a sea component of polyethylene terephthalate obtained by copolymerizing 6 mol % of sodium 5-sulfoisophthalate and 6% by weight of polyethylene glycol having a number average molecular weight of 4000 (melt viscosity at 280° C.: 1750 poise) (dissolution rate ratio (sea/island): 230) were melt-spun at a spinning temperature of 280° C. and spinning rate of 1500 m/min followed by temporary winding.

The resulting undrawn yarn was roller-drawn at a drawing temperature of 80° C. and drawing ratio of 2.5 followed by winding after heat-setting at 150° C. The resulting sea-island composite drawn yarn (fibers for filament yarn A) was 56 dtex/10 fil, and when horizontal cross-sections of the fibers were observed with a transmitting electron microscope (TEM), the shape of the islands was determined to be round, and the diameter of the islands was 710 nm.

On the other hand, commercially available polyurethane elastic yarn (fineness: 22 dtex/1 fil, Asahi Kasei Corp.) was prepared for use as the filament yarn B.

Next, using a 36 gauge warp knit tricot knitting machine, the polyurethane elastic yarn was supplied to the back after winding onto a beam while drawing at a ratio of 2.0 while simultaneously supplying the sea-island composite drawn yarn to the front by winding onto a beam, thereby knitting a knitted fabric having a half structure (back: 10/12, front: 23/10). Next, the knitted fabric was subjected to 30% alkaline weight reduction at 70° C. in a 3.5% aqueous NaOH solution in order to remove the sea component of the sea-island composite drawn yarn. Subsequently, after carrying out high-pressure dyeing for 30 minutes at 130° C., final setting was carried out in the form of dry heat setting at 170° C. to obtain a knitted fabric (fabric for an undergarment).

Figure 5:
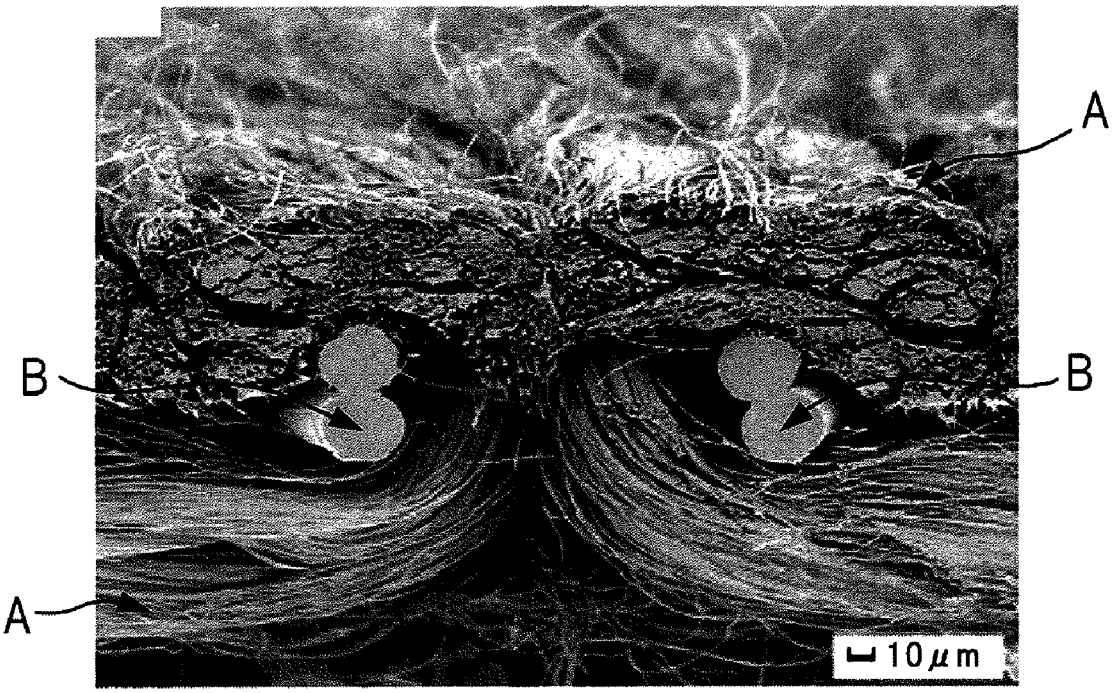
FIG. 5 is a micrograph showing a cross-sectional surface of a fabric used in an undergarment of the present invention.

In the resulting knitted fabric, the filament diameter of the filament yarn A (39 dtex/8360 fil) was 710 nm, while the filament diameter of the filament yarn B was 35 μm. In addition, only the filament yarn A was exposed on the top surface and back surface of the knitted fabric as shown in FIG. 5. As shown in Table 1, the frictional resistance value of the knitted fabric was 2.5 times or more that of the fabric obtained in Comparative Example 1 both in the dry state and wet state.

In addition, when the knitted fabric was used for the fabric of the cup liners and wings of a brassiere, namely at those locations in contact with the skin, and a knitted fabric having a tricot half structure, which uses ordinary polyester drawn yarn (56 dtex/36 fil) for the front and uses commercially available polyurethane elastic yarn (fineness: 22 dtex/1 fil, Asahi Kasei Corp.) for the back, was used for the cup surface fabric, followed by assembling the brassiere and test-wearing, both adherence to the skin and comfort were found to be superior as shown in Table 2. In addition, shape retention was also superior.

Comparative Example 1

Comparative Example 1 was carried out in the same manner as Example 1 with the exception using ordinary polyethylene terephthalate multifilament drawn yarn (total fineness: 33 dtex/36 fil, Teijin Fibers Ltd.) instead of the sea-island composite drawn yarn used in Example 1, and not carrying out alkaline weight reduction. In the resulting knitted fabric, the filament diameter of the polyethylene terephthalate multifilament drawn yarn was 10 μm.

When the knitted fabric was used for the fabric of the cup liners and wings of a brassiere, namely those at those locations in contact with the skin, followed by assembling the brassiere and test-wearing, adherence to the skin was found to be inferior as shown in Table 2.

TABLE 1

| | Maximum Surface Frictional Force (g) | | | |
|---|---|---|---|---|
| | Dry State | | Wet State | |
| | Example 1 | Comp. Ex. 1 | Example 1 | Comp. Ex. 1 |
| Vertical direction | 332 | 117 | 348 | 124 |
| Horizontal direction | 344 | 117 | 340 | 131 |

TABLE 2

| Evaluated Parameter | | Example 1 | Comp. Ex. 1 |
|---|---|---|---|
| Exposure Ratio of Polyester Filament Yarn A (%) | Top surface | 100 | 0 |
| | Back surface | 100 | 0 |

TABLE 2-continued

| Evaluated Parameter | | Example 1 | Comp. Ex. 1 |
|---|---|---|---|
| Adherence to Skin | Grade 3 | 10 persons | 0 persons |
| | Grade 2 | 0 persons | 10 persons |
| | Grade 1 | 0 persons | 0 persons |
| Comfort | Grade 3 | 8 persons | 0 persons |
| | Grade 2 | 2 persons | 10 persons |
| | Grade 1 | 0 persons | 0 persons |

Industrial Applicability

According to the present invention, an undergarment is provided that favorably adheres to the skin and has superior shape retention, and the industrial value thereof is extremely large.

The invention claimed is:

1. An undergarment comprising a fabric having a woven structure, a knitted structure or a non-woven fabric structure, wherein the fabric contains a filament yarn A having a filament diameter of 10 to 1000 nm and a filament yarn B having a filament diameter greater than 1000 nm, and the filament yarn A is exposed on the side that contacts the skin, wherein the frictional resistance value of the side that contacts the skin is 150 gr or more as determined according to the measurement method described below:

the frictional resistance value is the resistance value (gr) determined by placing a piece of silicone rubber on a horizontal table, arranging a head having a bottom surface area of 5 cm×8 cm, a height of 3 cm and a weight of 100 gr (0.98 N) on which a sample is affixed to the entire bottom surface thereof on the silicone rubber, and pulling the head in the horizontal direction at a rate of 100 mm/min with a tensile tester followed by determining the resistance value (gr) at that time.

2. The undergarment according to claim 1, wherein the exposed filament yarn A accounts for 50% or more of the surface area of the side that contacts the skin.

3. The undergarment according to claim 2, wherein only the filament yarn A is exposed on the side that contacts the skin.

4. The undergarment according to claim 1, wherein the number of filaments of the filament yarn A is 500 or more.

5. The undergarment according to claim 1, wherein the number of filaments of the filament yarn B is within the range of 1 to 300.

6. The undergarment according to claim 1, wherein the fabric is a knitted fabric obtained by interlocking the filament yarn A and the filament yarn B.

7. The undergarment according to claim 1, wherein the filament yarn A is a polyester fiber.

8. The undergarment according to claim 1, wherein the filament yarn B is an elastic fiber.

9. The undergarment according to claim 1, wherein the weight ratio of the filament yarn A to the filament yarn B is within the range of 95:5 to 5:95.

10. The undergarment according to claim 1, wherein the undergarment is any undergarment selected from the group consisting of brassieres, shorts, lingerie, girdles, undershirts, men's underpants and women's underpants.

* * * * *